United States Patent [19]

Graham et al.

[11] 4,238,947

[45] Dec. 16, 1980

[54] WORK ROLL CHOCK ASSEMBLY FOR A ROLLING MILL

[75] Inventors: Howard A. Graham, Belleville, Ill.; Charles Palubiak, St. Louis, Mo.

[73] Assignee: National Steel Corporation, Pittsburgh, Pa.

[21] Appl. No.: 37,935

[22] Filed: May 9, 1979

[51] Int. Cl.[3] ..... B21B 31/02

[52] U.S. Cl. ..... 72/237

[58] Field of Search ..... 72/237, 238, 239

[56] References Cited

U.S. PATENT DOCUMENTS

| | | | |
|---|---|---|---|
| 3,171,304 | 3/1965 | Sims et al. | 72/238 |
| 3,312,096 | 4/1967 | Stubbs et al. | 72/238 |
| 3,314,263 | 4/1967 | Hill | 72/237 |
| 3,570,296 | 3/1971 | Buta | 72/237 |
| 3,733,875 | 5/1975 | Steimer | 72/237 |
| 3,805,572 | 4/1974 | Busch | 72/238 |
| 3,864,954 | 2/1975 | Elbe et al. | 72/238 |

*Primary Examiner*—Milton S. Mehr

*Attorney, Agent, or Firm*—Shanley, O'Neil and Baker

[57] ABSTRACT

A rolling mill stand has upper and lower work rolls supported in chocks which include liner plates on their side faces for bearing against the side faces of the mill stand housing, with the side faces of the chocks being shaped so that the liner plates on both the upper and lower work roll chocks extend both above and below the pass line defined by the work rolls. Projections on one chock and its liner plates extend into corresponding recesses on the other chock and its liner plates so that portions of liner plates on the two chocks extend in generally side-by-side relation in a region extending across the pass line.

21 Claims, 8 Drawing Figures

WORK ROLL CHOCK ASSEMBLY FOR A ROLLING MILL

BACKGROUND OF THE INVENTION

1. Field of the Invention

This invention relates to rolling mill bearing chock supports and more particularly to an improved wear-plate structure providing increased support and alignment stability for the work roll bearing chocks in a rolling mill.

2. Description of the Prior Art

The invention may readily be adapted for use in various rolling mill configurations, but is particularly well-suited for application to a four high strip mill and will be described in conjunction with such a mill. More specifically, the invention will be described with particular reference to a high-speed four high strip mill of the general type disclosed and described in U.S. Pat. No. 3,733,875. Mills of this type employ upper and lower work rolls which cooperate to define a pass line at their nip for the strip to be rolled therebetween, with the ends of the rolls being supported in bearing chocks which, in turn, are mounted in the windows of mill housings disposed one on each side of the pass line, with the chocks and the work rolls supported therein being removable as a unit from the operator side of the mill. Upper and lower backup rolls also have their ends supported in chocks mounted in the mill housings, with power-driven screwdowns forcing the backup rolls into rolling engagement with the work rolls during operation of the mill.

The axes of the upper and lower work rolls and the large upper and lower backup rolls are contained in a common vertical plane so that the extremely heavy workloads exerted by the power-driven screwdowns, through the backup roll chocks and rolls, to the work rolls should theoretically produce only a vertical load on the work bearing chocks in the static load condition. However, minor misalignments inherent in such equipment as a result of manufacturing tolerances, wear, strain, and the like, and as a result of loads produced by the roll drive and by the workpiece moving through the millstand, produce very heavy loads on the work roll chocks tending to upset the coplanar relation of the roll axes and, as a result, the millstand housings must place heavy restraining loads on the work roll chocks. These heavy loads have, in the past, caused wear on the bearing surfaces of both work roll chocks and the mill housing. To minimize this wear, and to facilitate maintenance of the roll stands, it has been conventional practice to provide wear plates, or liners, in the form of high-strength hardened steel plates on the face of the mill housing and on the adjacent face of the roll chocks. While these liner plates have generally been effective in reducing wear and keeping the chocks centered in the mill housing, there have been instances where the chocks have been permitted to move sufficiently to produce a hammering effect causing excessive wear on the liner plates and in extreme cases to cause wear or damage to the face of the mill housing beneath the liner. This has been particularly true in the case of the lower work roll chock which generally has been provided with substantially smaller liner plate area than the top work roll chock. Examples of known rolling mills wherein liner plate for the bottom work roll chock is substantially smaller than that of the top work roll chock can be found in the above-mentioned U.S. Pat. No. 3,733,875 and U.S. Pat. No. 3,864,954. Other known rolling mill configurations similarly employ liner plates of unequal area on the lower and upper work roll bearing chocks.

It is a primary object of the present invention to provide an improved chock structure for the work rolls of a rolling mill.

Another object of the invention is to provide a lower work roll bearing chock having an increased liner support surface.

Another object of the invention is to provide a rolling mill including upper and lower work roll bearing chocks having liner plates rigidly mounted thereon and including means for providing an increased vertical dimension for the lower work roll bearing chock liner plate to thereby provide greater strength and dimensional stability for the lower work roll bearing chock.

Another object is to provide a rolling mill in which the upper and lower work roll chocks have substantially equal bearing face areas in contact with the supporting mill housing.

SUMMARY OF THE INVENTION

In the attainment of the foregoing and other objects and advantages of the invention, an important feature of the invention resides in providing an increased surface area for the liner plates employed on the lower work roll chock of a rolling mill. This can be accomplished by providing a recess in the bottom edge portions of the top work roll chocks and liner plates, and forming an upwardly projecting extension on the top edge portions of the lower work roll chocks and liner plates to project into the recess into the upper chock. These upwardly projecting extensions provide a substantially increased vertical height for the lower chock liner plate over a portion of its transverse width which provides an increased moment greatly resisting the turning or twisting action of the lower chock around the axis of the roll. This results in a considerably improved roll stability and greater mill stand and liner plate life.

BRIEF DESCRIPTION OF THE DRAWINGS

Other objects and advantages of the invention will become apparent from the detailed description contained hereinbelow, taken in conjunction with the drawings, in which.

DESCRIPTION OF THE PREFERRED EMBODIMENTS

Figure 1:
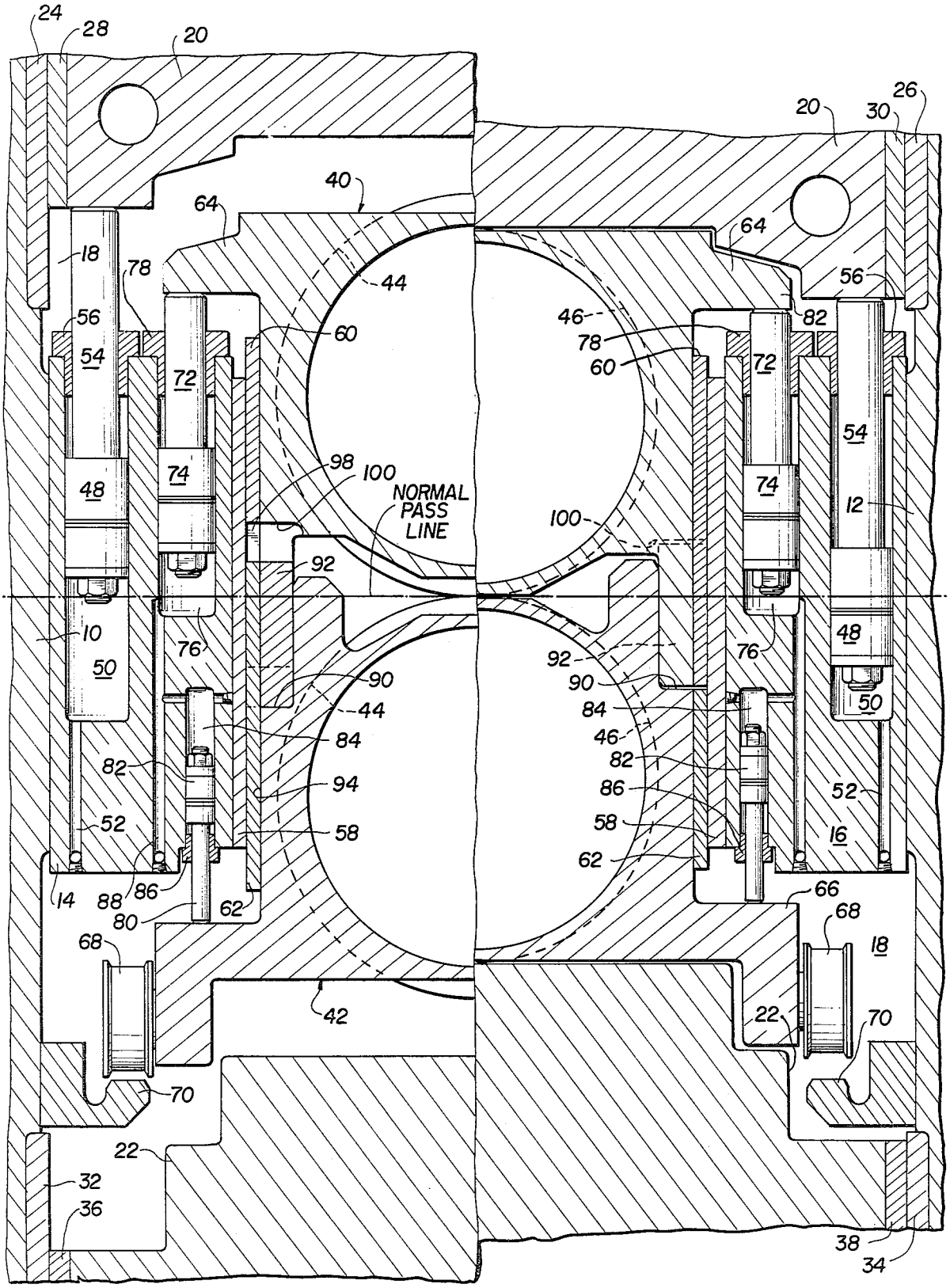
FIG. 1 is a fragmentary sectional view, in elevation, of a rolling mill stand embodying the present invention and with certain components shown in alternate positions in the left and right sides, respectively, of this view.

Referring now to the drawings in detail, one embodiment of the invention will be described as incorporated in a four high rolling mill stand, with fragmentary portions of the opposing walls 10, 12 of one mill stand housing being shown in FIG. 1. A pair of support blocks 14, 16 are rigidly mounted on the inwardly directed face of walls 10, 12 respectively, with the support blocks projecting into the central opening, or window 18, of the housing. Suitable mounting bolts or the like, not shown, are employed to rigidly mount the support blocks onto the opposing faces of the housing walls near the mid-section of the window in the conventional manner.

A pair of backup rolls, not shown, are supported in upper and lower backup roll chocks 20, 22, respectively. A pair of wear plates or liners 24, 26 are mounted on the opposed faces of wall 10, 12 to provide a vertical sliding bearing surface for liner plates 28, 30, respectively, rigidly mounted on the sidewalls of upper backup chock 20. Similarly, liners 32, 34 mounted on walls 10, 12, respectively, provide sliding bearing surface for liner plates 36, 38, respectively, mounted on lower backup roll chock 22.

The mill stand work roll assembly is supported within the windows of the mill stand housings between support blocks 14, 16 and the upper and lower backup rolls, not shown. As seen in FIG. 1, the work roll assembly includes at each housing an upper work roll chock 40 and a lower work roll chock 42 each having a cylindrical bore therein defining the bearing box for the work rolls. As is conventional practice, the mill stand is adapted to accept work rolls of various diameters, and the relative location of the upper and lower work roll chocks and the upper and lower backup roll chocks, and of other associated components described hereinbelow are illustrated in FIG. 1 for a maximum diameter work roll on the left side of the vertical center line of the assembly and for a minimum diameter work roll on the right side of the center line. The maximum diameter of the upper and lower work rolls is indicated by the line 44, and the minimum diameter of these rolls indicated by the line 46. Since the axes of the work rolls remains fixed in the respective work roll chocks, the use of different sized work rolls will result in a change in the vertical spacing between the work roll chocks, with this vertical spacing for different sized work rolls being dramatically shown in the split illustration of FIG. 1. Similarly, an increased size work roll will produce an increased spacing between the work roll chocks and the adjacent backup roll chocks, which increase in spacing may be further influenced by the diameter of the backup roll used.

The upper backup roll chock 20 is normally urged in an upward direction against the upper mill screwdown (not shown) by balancing cylinder means in the support blocks 14, 16. Insofar as this invention is concerned, the structure of the mill stand is symmetrical about the vertical plane containing the axes of the rolls, and accordingly identical reference numerals will be used to identify like parts on each side of this plane. Thus, the balancing cylinder means includes pistons mounted for vertical movement for cylinders 50 milled in each of the support blocks 14, 16. Hydraulic pressure is supplied through drilled passageways 52 into the cylinders 50. Rigid vertical plungers or rods 54 mounted on and projecting upwardly from the pistons 48, pass through sealed guide bushings 56 and bear against the bottom surface of the chock 20. While only one balancing cylinder is shown in each support block for convenience of illustration, two such balancing cylinders may be employed in each support block to provide a more uniform or balanced force supporting the chock 20 and backup roll mounted therein.

The internal bearing face surfaces of support blocks 14 and 16 are provided with hardened liner plates 58 which provide smooth bearing surfaces for liner plates 60 mounted on the opposed side faces of upper work roll chock 40 and liner plates 62 mounted on the opposed side faces of lower work roll chock 42. Liner plates 60 and 62 will be described more fully hereinbelow.

Upper work roll chock 40 is provided with a pair of lateral projections 64 which extend outwardly one over a portion of each of the support blocks 14, 16, and lower work roll chock 42 is provided with a pair of lateral projections 66 which project beneath the support blocks. Support wheels 68 are mounted on the outer surface of projections 66, in position to support the work roll assembly on rails 70 mounted on the face of walls 10, 12 for installation and removal of the work roll assembly in the conventional manner.

The upper and lower work roll chocks are urged away from one another to maintain the work rolls supported therein in contact with the backup rolls. This is accomplished by a balancing system mounted within and supported by the support blocks 14, 16, with the balancing system being unattached to the chocks to facilitate changing the work roll assembly in the mill stand. The balancing mechanisms in the respective support blocks are substantially identical and include a vertical plunger 72 supported by a piston 74 mounted in the cylinder 76 formed in and extending downwardly into the top portion of each of the support blocks 14, 16. Plunger 72 is guided by a suitable sealed bushing 78 in the top of cylinder 76, with the plunger 72 projecting upwardly and bearing against the overhanging projection 64 of chock 40. A somewhat smaller plunger 80 is attached to a piston 82 vertically movable in a cylinder 84 in the bottom portion of the support block 14. A sealed bushing 86 guides the plunger 80 for vertical movement upon application of fluid pressure in cylinder 84 to urge the plunger downwardly into engagement with the top surface of lateral projection 66. Fluid pressure is applied to the cylinders 84 and 76 simultaneously through common channels 88 formed in the associated support blocks. The difference in sizes of the cylinders 84 and 76 is such as to produce a substantially equal force between the upper work roll and the upper backup roll and between the lower work roll and lower backup roll, due to the weight of the lower roll and chock assembly acting with the smaller cylinder 84, and the weight of the upper work roll and chock assembly working against the upper cylinder 76.

In four high rolling mills of the type thus far described, and as illustrated in the above-mentioned U.S. Pat. No. 3,733,875, the upper work roll chock 40 normally extends downwardly along the support blocks 14, 16 to a position below the horizontal pass line defined by the nip of the work rolls during operation of the mill. Thus, in an existing four high rolling mill prior to modification to incorporate the present invention, the vertical height of the liner plates 60 mounted on the top work roll chock 40 was approximately 23¼ inches whereas the corresponding dimension of the liner plates 62 on the bottom work roll chock was approximately 13¼ inches. In the same mill, the distance between the outwardly directed faces on the liner plates carried by the chocks was approximately 32-4/5 inches. As a result, extremely high unit pressures were frequently produced between the liner plates carried on the lower work roll chock and the liner plates carried on the support blocks, particularly at the bottom of the chock. Further, wear or tolerances in the system permitting movement of the bottom chock under the extremely heavy work loads encountered during high-speed rolling operations frequently resulted in extremely heavy impact loading tending to wear and hammer the opposed surfaces of the liner plates on the chock and the support block, and has even resulted in a distortion and a failure of the base metal of the support block beneath the hardened steel liner plate carried thereon. While any wear on the liner plates or supports blocks is undesirable, such wear on the support block is much more serious since the mill must be shut down for a substantial time to repair such wear. Similarly, wear on the support block liner plates and/or mill housing is more serious than wear on the chock liner plates since wear to the liner plates to the chocks can be repaired while the work rolls are removed whereas damage to the support block liners and/or mill housing requires a complete shut down of the mill for repair.

Prior to modification of the mill to incorporate the present invention, the lower work roll chock 42 had a recess extending along its top edges parallel to the axes of the rolls in position to receive downwardly projecting flanges on the top chock 40. The recesses in the bottom chock terminated in a shoulder 90 which extended completely across the width of the chock in the direction parallel to the axis of the roll, with this shoulder 90 defining the top extremity of liner plates 60 and with the shoulder 90 being located substantially below the nip of the rolls. Further, with the use of a large diameter work roll, the bottom chock was lowered even further so that the bottom portion of the liners 60 projected below the bottom of the support block liner plates 58, thereby reducing even further the effective area of the adjacent liner plates in providing lateral stability to the bottom work roll.

Figure 3:
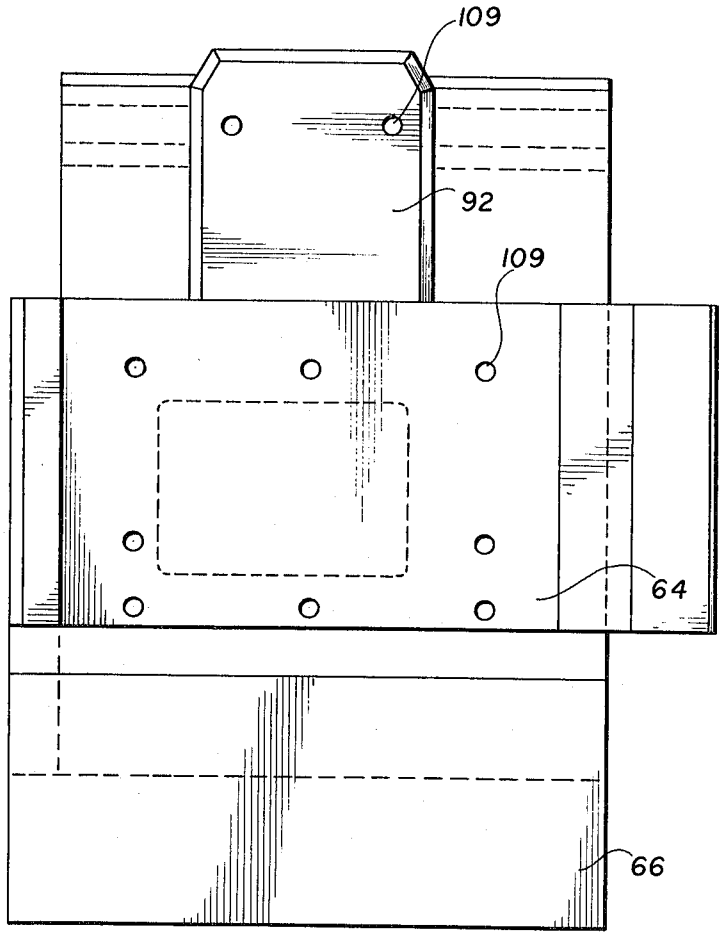
FIG. 3 is a side elevation view of the lower work roll chock shown in FIG. 1.
Figure 2:
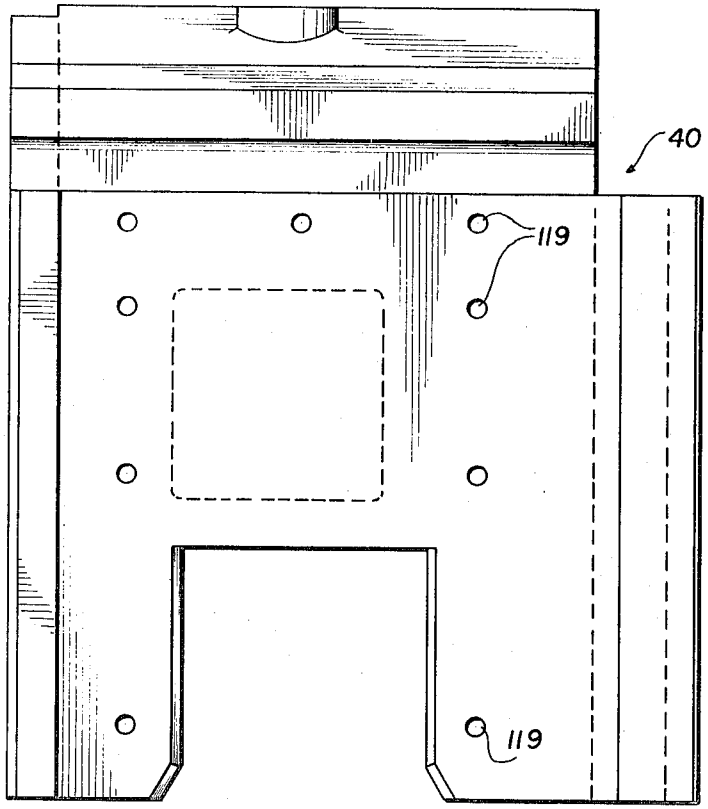
FIG. 2 is a side elevation view taken of the top work roll chock shown in FIG. 1.
Figure 6:
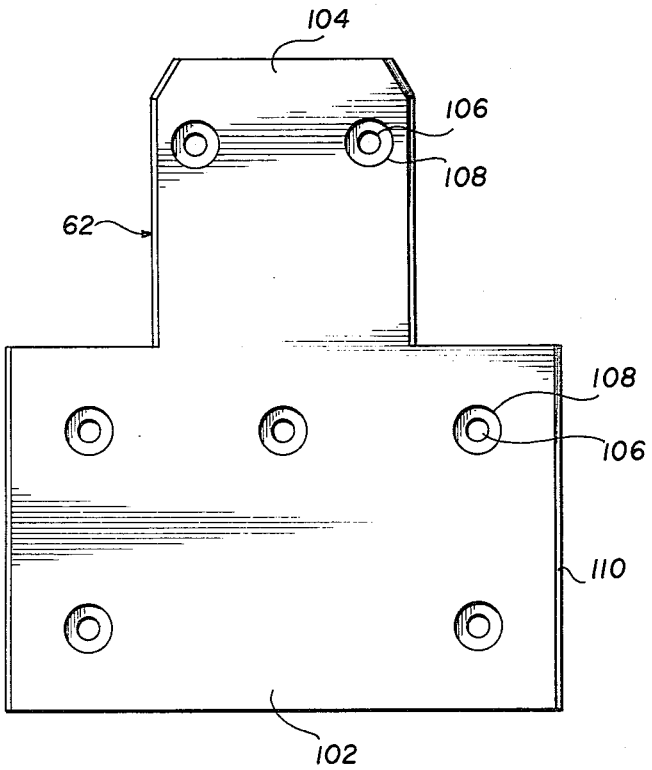
FIG. 6 is an elevation view of the liner plate mounted on the bottom work roll bearing chock.

In order to provide increased stability for the bottom work roll, chock 42 was modified in accordance with the present invention by rigidly mounting a metal filler block 92 onto the side surfaces of the chock above the shoulders 90 with the filler blocks 92 resting on the shoulders and having their outer surface extending in coplanar relation with the vertical outer surfaces 94 of the chock 42 to which the lower plates 60 are attached. As shown in FIG. 3, filler block 92 has a width dimension, measured parallel to the work roll axis, which is slightly less than one-half the total width dimension of the chock 42, and height dimension slightly greater than the height of the channel so that block 92 projects slightly above the top of chock 42. At the same time, the original substantially rectangular liner plates mounted on the lower chock 42 are replaced with the liner plates 62 having the general configuration of an inverted "T" as shown in FIG. 6. This liner plate configuration substantially increased the stability of chock 42 due to the increased vertical extent of the bearing surface between liner plates 58 and 62.

A generally rectangular cut-out or recess 98 is formed in the bottom edge of the liner plates 60 mounted on top work roll chock 40, with the recesses 98 being slightly wider than the rectangular extensions 104 formed on the top edge of the liner plates 62. Thus, when installed on a working mill stand, the liner plates 60, 62 mounted on the top and bottom work roll chocks, respectively, are interfitted in a generally tongue-and-groove relation. Also, in order to accommodate the backup block 92, a recess 100 is formed in the downwardly directed surface of chock 40 adjacent the edges thereof in the area underlying the rectangular recess 98 in the liner plates 60.

Figure 7:
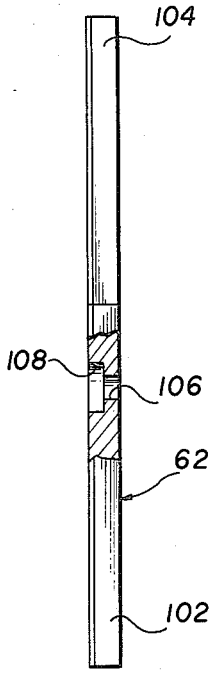
FIG. 7 is a side elevation view of the liner plate shown in FIG. 6.
Figure 8:
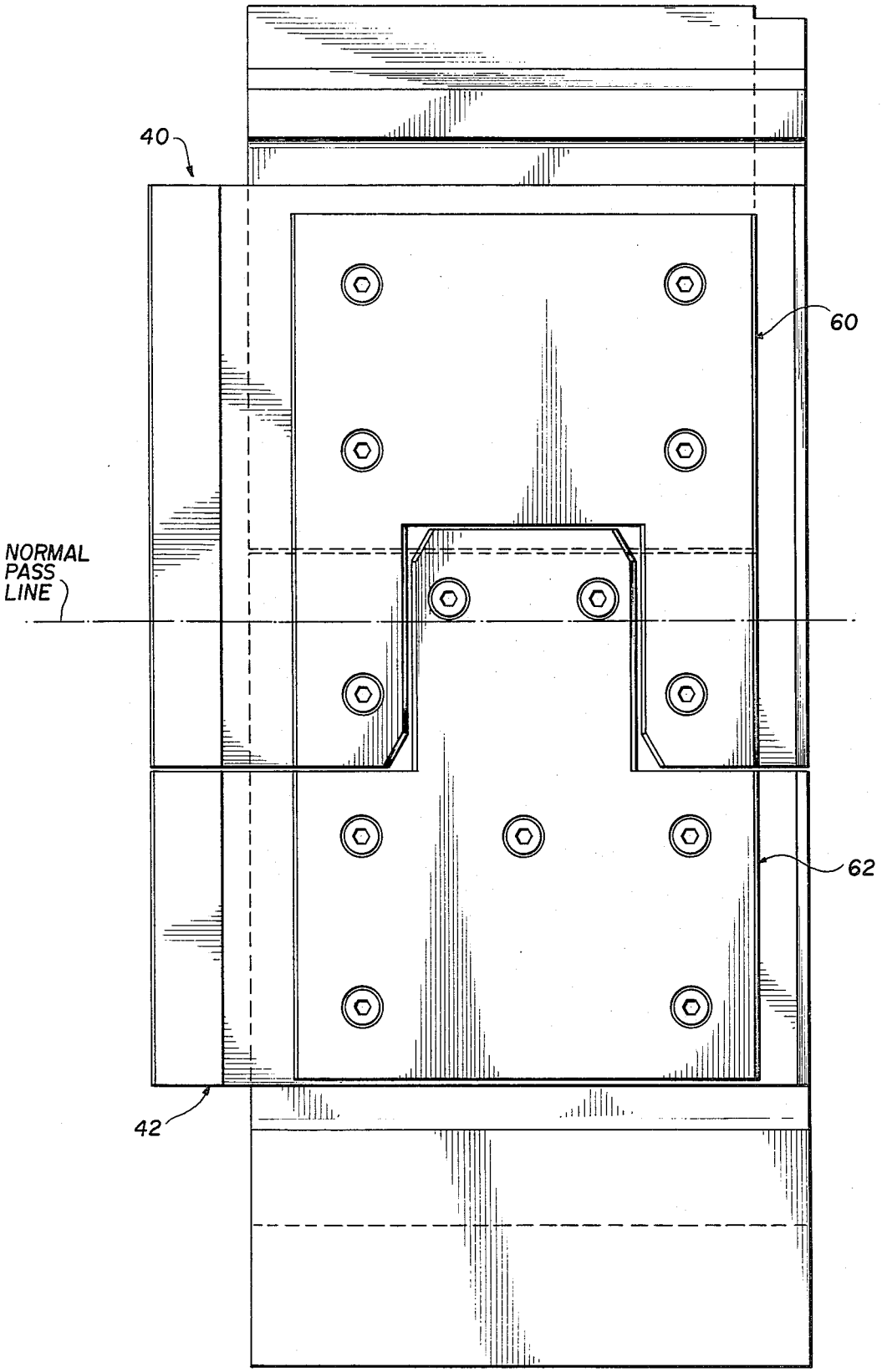
FIg. 8 is an elevation view of the top and bottom work roll chocks, with liners installed, in their normal working relation.

Referring now to FIGS. 6 and 7, it is seen that the liner plates 62 mounted on the bottom chock 42 comprises a generally rectangular base segment 102 with a generally rectangular upwardly directed extension 104 integrally formed thereon. A plurality of bore holes 106 having counterbored recesses 108 are provided in the liner plate to accommodate mounting bolts (not shown) for rigidly mounting the liner plates on the chock 42 using mounting holes 109. In the embodiment shown, the surface area of the work side of the extension 104, i.e., the side bearing against liner plate 58 during use, is preferably within the range of about 30 to 40% of the total area of the rectangular base portion 102, with the transverse width of the rectangular extension 104 being no more than about half the total width of the rectangular base portion. The vertical side edges of the liner plates are levelled as indicated at 110 to facilitate inserting the work roll assembly into a mill stand.

Figure 4:
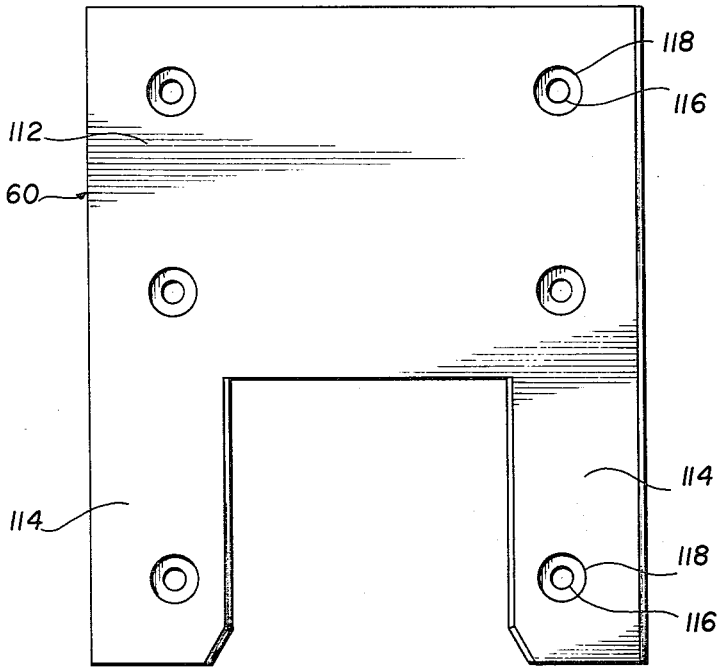
FIG. 4 is an elevation view of a liner plate employed on the top work roll bearing chock.
Figure 5:
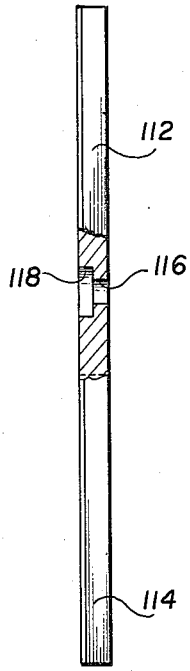
FIG. 5 is a side elevation view, with portions broken away, of the liner plate shown in FIG. 4.

The top chock liner plates 60 shown in FIGS. 4 and 5 consists of a top rectangular body segment 112 having a total width equal to the width of the chock 40 and a pair of integrally formed, downwardly extending rectangular fingerlike extensions, or sections 114 dimension to extend one on each side of the upwardly directed extension 104 on the lower chock liner plate installed in a mill. A plurality of mounting holes 116, each including a counterbore 118 extending from the work surface, are provided to accommodate mounting bolts, not shown, for mounting the liner plate using mounting holes 119 in chock 40. Preferably the total work surface area of downwardly extending sections 114 is within the range of about 30 to 40% of the area of the base section 112.

The total vertical height and the total work surface area of the liner plates 60 and 62 are preferably substantially equal. Thus, regardless of the size of work roll involved, the bearing surface area provided by the liner plates on the top and the bottom chock rolls are substantially equal so that the top and bottom chocks are more equally stabilized. It has been found that this stabilizing effect materially reduces the wear between the bottom chock liner and the adjacent support block liner and has eliminated damages to the support block beneath the support block liner plate. This deceptively simple, yet unobvious, modification to the mill stand has greater prolonged the life of the stand and substantially reduced downtime for repairs to the support blocks and replacement of support block liner plates.

The interfitting, tongue-and-groove configuration has been found to produce a greater stability and result in less wear than is obtained by rectangular wear plates of unequal surface area. This is believed to result from the greater effective height achieved by this unique configuration over that obtained from conventional designs. Further, the increased stability and wear resistance of the lower chocks and liners are achieved without substantial loss of stability or wear resistance of the top chocks and liners.

While I have disclosed and described the preferred embodiments of my invention, I wish it understood that I do not intend to be restricted solely thereto, but rather that I intend to include all embodiments thereof which would be apparent to one skilled in the art and which come within the spirit and scope of my invention.

We claim:

1. A rolling mill stand comprising upper and lower work roll chocks adapted to be removably mounted in the window of a mill housing, upper and lower work rolls supported in said chocks and cooperating to define a pass line for material to be rolled therebetween, a pair of liner plates rigidly mounted on each of said upper and lower work roll chocks for aligning the chocks in a mill housing window, said chocks each having vertical support surfaces thereon including portions extending both above and below the pass line defined by the work rolls supported in the chocks, said vertical support surfaces underlying and providing support for said liner plates mounted on the chocks, said liner plates each also including portions extending both above and below said pass line.

2. The rolling mill stand as defined in claim 1 wherein said liner plates on said upper and lower work roll chocks each comprise a generally rectangular vertically extending base segment and at least one coplanar extension integrally formed therewith and extending from one side thereof, said base segments of the liner plates on said upper work roll chock being disposed above said pass line and the base segments of the liner plates on said lower work roll chock being disposed below said pass line, said extensions each extending across said pass line during operation of the mill stand.

3. The rolling mill stand as defined in claim 2 wherein said extensions are generally rectangular.

4. The rolling mill stand as defined in claim 3 wherein the total transverse dimension of said extensions on each liner plate, measured parallel to the axes of said work rolls, is no greater than about one-half the transverse dimension of said base segments.

5. The work roll stand as defined in claim 4 wherein the liner plates on the upper and lower work roll chocks have substantially the same vertical height.

6. The rolling mill stand as defined in claim 4 wherein the liner plates on the upper and lower work roll chocks have substantially equal areas.

7. The rolling mill stand as defined in claim 2 wherein the liner plates mounted on one of said work roll chocks has a single extension formed thereon in the form of a generally rectangular vertically extending plate segment located substantially symmetrically with respect to the vertical center line of the integrally formed body segment, and wherein the liner plates mounted on the other of said work roll chocks has a pair of extensions formed thereon, said pair of extensions being in the form generally rectangular plate segments spaced laterally from one another a distance to receive one of said single rectangular segments therebetween in substantially coplanar relation therewith.

8. The rolling mill stand as defined in claim 7 wherein the total transverse dimension of said extensions on each liner plate, measured parallel to the axes of said work rolls, is no greater than about one-half the transverse dimension of said base segments.

9. The work roll stand as defined in claim 8 wherein the liner plates on the upper and lower work roll chocks have substantially the same vertical height.

10. The rolling mill stand as defined in claim 6 wherein the liner plates on the upper and lower work roll chocks have substantially equal areas.

11. In a rolling mill stand having upper and lower work rolls cooperating to define a pass line for material to be rolled therebetween, a mill housing having a window therein located on each side of the stand, a pair of liner plates rigidly mounted in the window of each mill housing in spaced vertically extending relation to one another, the liner plates being located one on each side of the work roll axis and parallel thereto, upper and lower work roll chocks removably mounted on each mill housing window supporting said work rolls for rotation about spaced parallel axes and for limited vertical movement toward and away from one another, the upper and lower work roll chocks each comprising, a pair of vertically extending bearing surfaces adapted to engage the pair of vertically extending liner plates and cooperate therewith to guide the chocks in their limited vertical movement toward and away from one another and restrain the chocks against lateral movement in the direction of the pass line and against rotational movement about the axes of the rolls, the vertically extending bearing surfaces on each such chock including portions extending both above and below the pass line defined by the work rolls supported in the chocks.

12. The invention as defined in claim 11 wherein the bearing surfaces on said work roll chocks each comprise liner plate means rigidly mounted on vertically extending surfaces on each said chock in position to slidably engage the mill housing liner plate means and cooperate therewith to maintain the chocks in alingment within the mill housing window.

13. The invention as defined in claim 12 wherein the liner plate means on each said vertically extending surface of the lower work roll chocks comprises a generally rectangular body portion mounted on such vertically extending surfaces below the pass line defined by the work rolls and extending substantially the full transverse width of the portion of the chock located within the window of the mill housing, and a vertically extending portion integrally formed with and having a transverse width substantially less than said body portion, the vertically extending portion projecting upwardly from said body portion above said pass line during operation of the mill.

14. The invention as defined in claim 13 wherein the transverse width of the body portion of said liner plate means on said lower work roll chocks is at least substantially twice that of said integrally formed vertically extending portion.

15. The invention as defined in claim 12 wherein the liner plate means on each said vertically extending surface of the upper work roll chocks comprises a generally rectangular body portion mounted on such vertically extending surfaces above the pass line defined by the work rolls and extending substantially the full transverse width of the portion of the chock located within the window of the mill housing, and a vertically extending portion integrally formed with and having a transverse width substantially less than said body portion, the vertically extending portion projecting downwardly from said body portion below said pass line during operation of the mill.

16. The invention as defined in claim 15 wherein the transverse width of the body portion of said liner plate means on said upper work roll chocks is at least substantially twice that of said vertically extending portion.

17. The invention as defined in claim 12 wherein the liner plates means on each said vertically extending surface of the upper work roll chocks comprises a first generally rectangular body portion mounted on such vertically extending surfaces below the pass line defined by the work rolls and extending substantially the full transverse width of the portion of the chock located within the window of the mill housing, and a first vertically extending portion having a transverse width substantially less than that of said first body portion, the first vertically extending portion protecting above said pass line, and wherein the liner plate means on each said vertically extending surface of said lower work roll chocks comprises a second generally rectangular body portion mounted on such vertically extending surfaces above such pass lines and extending substantially the full transverse width of the portion of the chocks located within the window of the mill housing, and a second vertically extending portion integrally formed with and having a transverse width substantially less than that of said second body portion, the second vertically extending portion projecting downwardly from said second body portion below said pass line during operation of the mill.

18. The invention as defined in claim 17 wherein the transverse width of said first and second body portions of said liner plate each have a transverse width at least substantially twice that of the vertically extending portion integrally formed therewith.

19. The invention as defined in claim 18 wherein one of said vertically extending portions is in the form of a single generally rectangular plate section and the other of said vertically extending portions is in the form of a pair of laterally spaced, generally rectangular plate sections extending in generally coplanar relation with and one on each side of said one of said generally rectangular plate section.

20. The invention as defined in claim 19 wherein the vertical heights of said liner plates in said upper and said lower work roll chocks are substantially equal.

21. The invention as defined in claim 20 wherein the total bearing surface areas of said liner plates on said upper and said lower work roll chocks are substantially equal.

* * * * *